US005909770A

United States Patent [19]

Davis

[11] Patent Number: 5,909,770

[45] Date of Patent: Jun. 8, 1999

[54] RETRIEVABLE WHIPSTOCK

[75] Inventor: John P. Davis, Cypress, Tex.

[73] Assignee: Baker Hughes Incorporated, Houston, Tex.

[21] Appl. No.: 08/910,797

[22] Filed: Aug. 13, 1997

Related U.S. Application Data

[

[60] Provisional application No. 60/033,195, Nov. 18, 1996.

[51] Int. Cl.[6] ..... E21B 7/08

[52] U.S. Cl. ..... 166/117.6; 166/206; 175/81

[58] Field of Search ..... 166/117.5, 117.6, 166/206, 209, 211, 216, 382; 175/73, 81

[56] References Cited

U.S. PATENT DOCUMENTS

| | | | |
|---|---|---|---|
| 1,812,880 | 7/1931 | Kinzbach et al. . | |
| 1,821,426 | 9/1931 | Dumm et al. . | |
| 2,105,722 | 1/1938 | Barrett et al. . | |
| 2,170,284 | 8/1939 | Eastman . | |
| 2,211,803 | 8/1940 | Warburton . | |
| 2,401,893 | 6/1946 | Williams, Jr. . | |
| 2,445,100 | 7/1948 | Wright . | |
| 2,699,920 | 1/1955 | Zublin . | |
| 2,725,936 | 12/1955 | Hester . | |
| 2,882,015 | 4/1959 | Beck . | |
| 5,035,292 | 7/1991 | Bailey et al. . | |
| 5,109,924 | 5/1992 | Jurgens, et al. . | |
| 5,193,620 | 3/1993 | Braddick . | |
| 5,222,554 | 6/1993 | Blount et al. . | |
| 5,277,251 | 1/1994 | Blount et al. . | |
| 5,335,737 | 8/1994 | Baugh . | |
| 5,341,873 | 8/1994 | Carter et al. . | |
| 5,346,017 | 9/1994 | Blount et al. . | |
| 5,361,833 | 11/1994 | Schock et al. . | |
| 5,383,522 | 1/1995 | Hailey . | |
| 5,398,754 | 3/1995 | Dinhoble | 166/117.6 |
| 5,423,387 | 6/1995 | Lynde . | |
| 5,427,179 | 6/1995 | Bailey et al. . | |
| 5,467,819 | 11/1995 | Braddick . | |
| 5,474,126 | 12/1995 | Lynde et al. . | |
| 5,494,111 | 2/1996 | Davis et al. . | |
| 5,535,822 | 7/1996 | Schock et al. . | |
| 5,566,762 | 10/1996 | Braddick et al. . | |
| 5,592,991 | 1/1997 | Lembcke et al. | 166/117.6 X |
| 5,595,247 | 1/1997 | Braddick . | |
| 5,647,437 | 7/1997 | Braddick et al. . | |
| 5,747,131 | 5/1998 | Jordan, Jr. et al. | 166/313 |
| 5,769,167 | 6/1998 | Braddick | 166/117.6 X |
| 5,785,133 | 7/1998 | Murray et al. | 175/61 |

FOREIGN PATENT DOCUMENTS

| | | |
|---|---|---|
| 2278136 | 11/1994 | United Kingdom . |
| 2299105 | 9/1996 | United Kingdom . |
| WO 95/07404 | 3/1995 | WIPO . |
| WO 96/04494 | 2/1996 | WIPO . |

OTHER PUBLICATIONS

Lynes 1978–1979 Catalog, 3 pgs.

*Primary Examiner*—George Suchfield
*Attorney, Agent, or Firm*—Rosenblatt & Redano P.C.

[57] ABSTRACT

A thru-tubing retrievable whipstock is disclosed. A running tool creates relative movement to pivot out anchors at the lower end of the whipstock to accomplish its support. The setting force is trapped by spring-loaded wedges. The whipstock can be released and retrieved through tubing by undermining the wedges which allows retrieval of the whipstock by a pick-up force on the whipstock which collapses the anchoring mechanism for retrieval of the entire assembly to the surface.

20 Claims, 9 Drawing Sheets

RETRIEVABLE WHIPSTOCK

This application claims benefit of provisional application Ser. No. 60/033,195 filed Nov. 18, 1996.

FIELD OF THE INVENTION

The field of this invention relates to whipstocks, particularly those that can be installed through tubing and subsequently retrieved.

BACKGROUND OF THE INVENTION

Whipstocks have been in use for a long time to kick off deviations in a wellbore. A whipstock is a long insert in the wellbore which has a tapered component to guide a mill to cut through a casing an opening called a window. A lateral is then drilled through the window. Many times the production in an existing well is reduced to a level that warrants the drilling of a lateral into a producing formation to enhance production. In so doing, there is usually a production string in the wellbore. It, therefore, becomes desirable to be able to set a whipstock below the production string to kick off the lateral. In the future, subsequent laterals may be called for and retrievability can also become a significant feature. Without the ability to retrieve a whipstock even if inserted through tubing, any laterals to be initiated below the level of the permanent whipstock that has been set through tubing would require the milling out of the whipstock after removing the production tubing, and the placement of another whipstock at a lower location in the proper orientation for kicking off yet another lateral from the main wellbore.

There have been many anchoring systems employed for whipstocks. Some of these are illustrated in U.S. Pat. Nos. 1,812,880; 2,105,722; 2,170,284; 2,401,893; 2,445,100; 2,699,920; 5,035,292; and 5,277,251. Techniques have been developed for supporting a whipstock through the use of a cementitious material where the whipstock is installed through tubing. The whipstock can be repositioned for other laterals if the cement is milled out and the underlying sand layer is circulated out. This technique is illustrated in U.S. Pat. No. 5,423,387. A retrieval technique for a whipstock using a hook-shaped retrieval tool insertable into a slot in the whipstock is illustrated in U.S. Pat. No. 5,341,873.

Yet other patents are of general interest in the area of whipstock setting and milling techniques. Those patents include U.S. Pat. Nos. 5,193,620; 5,109,924; 2,725,936; 2,882,015; 2,211,803; and 5,474,126.

More recently, a permanent thru-tubing whipstock has been disclosed in U.S. Pat. No. 5,494,111.

The object of this invention is to improve the design illustrated in the U.S. Pat. No. 5,494,111 to provide a whipstock that is insertable through tubing and retrievable. It is another objective of the design to allow for the use of running and retrieval tools of known design to accomplish the setting, release, and retrieval.

SUMMARY OF THE INVENTION

A thru-tubing retrievable whipstock is disclosed. A running tool creates relative movement to pivot out anchors at the lower end of the whipstock to accomplish its support. The setting force is trapped by spring-loaded wedges. The whipstock can be released and retrieved through tubing by undermining the wedges which allows retrieval of the whipstock by a pick-up force on the whipstock which collapses the anchoring mechanism for retrieval of the entire assembly to the surface.

DETAILED DESCRIPTION OF THE PREFERRED EMBODIMENT

Figure 4:
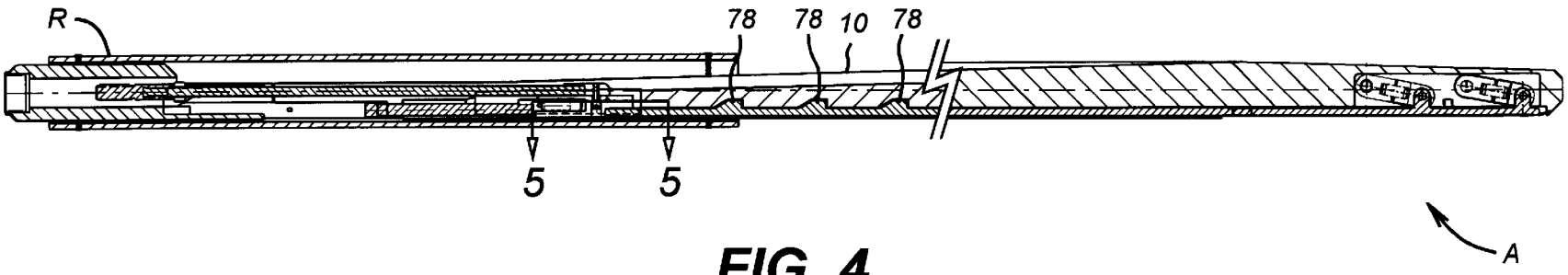
FIG. 4 is a sectional elevation of the overall assembly, greatly reduced to show the general placement of the major components.

FIGS. 1*a–d* illustrate the whipstock 10. The whipstock 10 has a tapered face 12 which is generally about 2° or 3°, although other slopes can be used without departing from the spirit of the invention. As is well-known in the art, the working face 12 is rounded so that when looking at it in section, it appears to be crescent shaped. Referring to FIG. 4, the whipstock 10 is illustrated, along with the running tool R, whose operation will be described below. Essentially, the running tool R creates relative movement for the setting of the whipstock 10. Other techniques for setting are within the scope of the invention. The anchoring assembly A is near the lower end of the whipstock 10, as illustrated in FIG. 4. The anchoring assembly A is shown in greater detail in FIG. 1*d.*

Figure 1B:
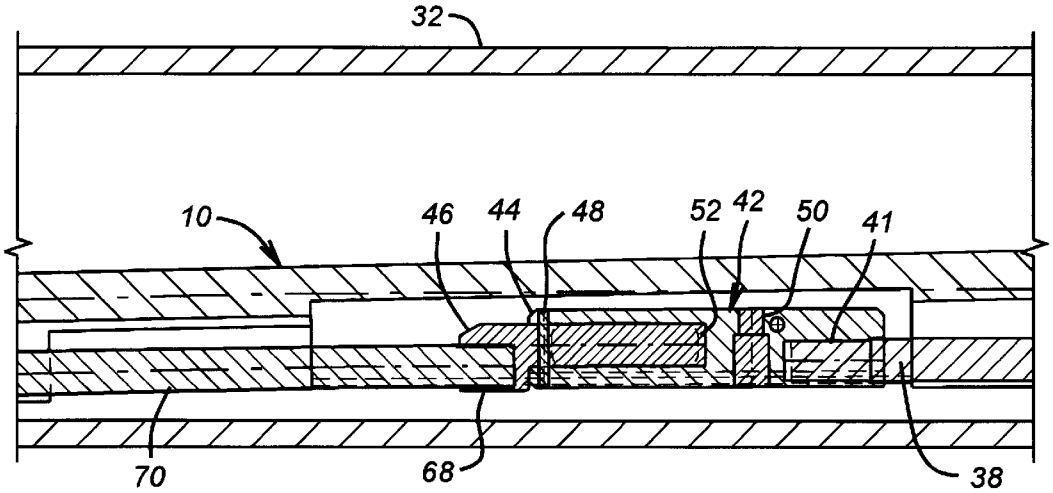
Figure 2B:
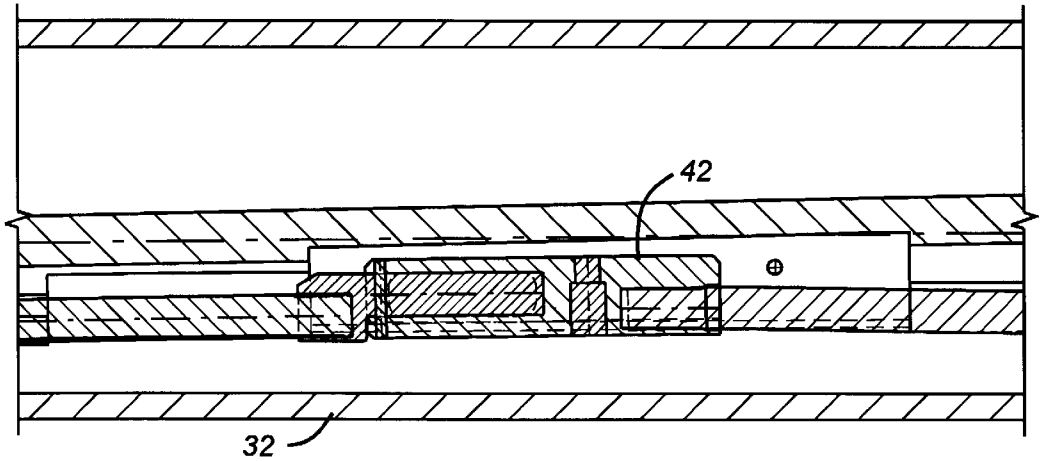
Figure 1C:
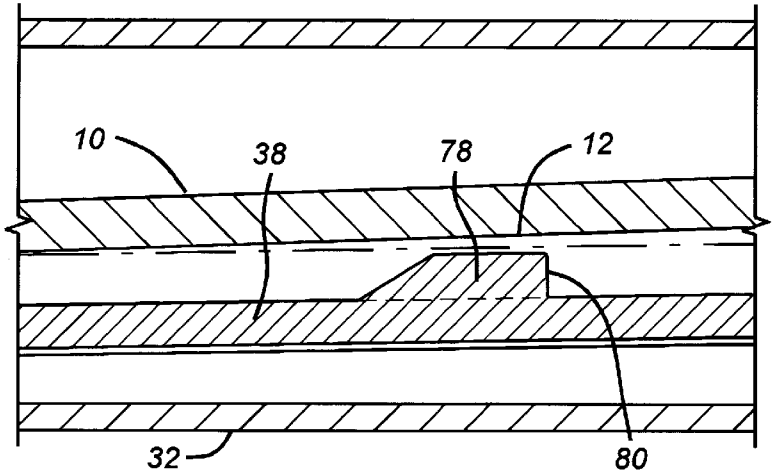
Figure 1D:
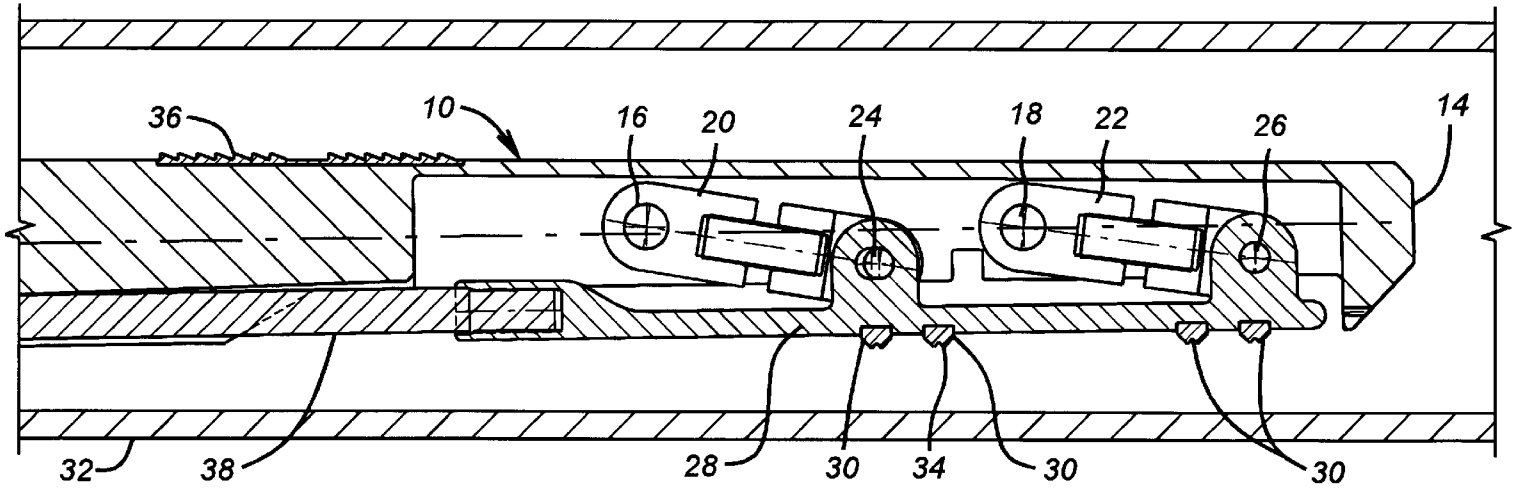

Referring now to FIG. 1*d,* the whipstock 10 has a lower end 14, near which are mounted pivot pins 16 and 18. Connected to pivot 16 is link 20, and connected to pivot 18 is link 22. Link 20 terminates in pin 24, and link 22 terminates in pin 26. Pins 24 and 26 are connected to the pad slip blank 28. Pad slip blank 28 has a plurality of carbide inserts 30 which extend outwardly to bite into the casing 32, shown in FIG. 2*d.* Each of the inserts 30 have forward-facing teeth 34 to improve the bite into the casing 32. Mounted to the whipstock 10, approximately 180° opposite from inserts 30, is a series of hardened carbide teeth 36. The setting of the whipstock 10 is accomplished by relative motion using the running tool R which holds the whipstock 10 stationary while the rod 38 is pulled upwardly.

Figure 1A:
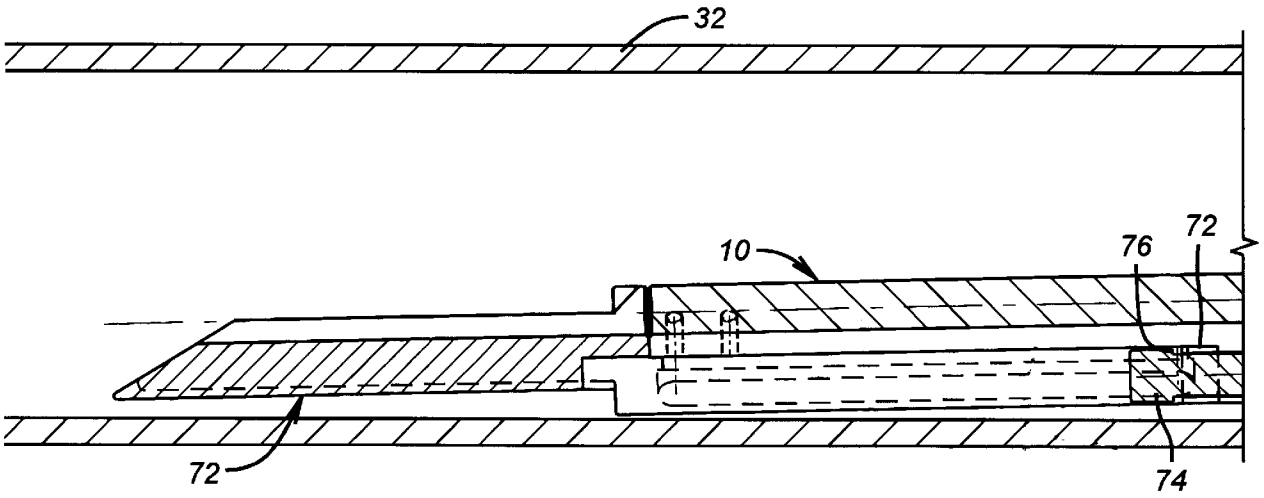
FIGS. 1*a–d* are a sectional elevational view of the retrievable thru-tubing whipstock in the run-in condition, shown with the central portions omitted for clarity.
Figure 2A:
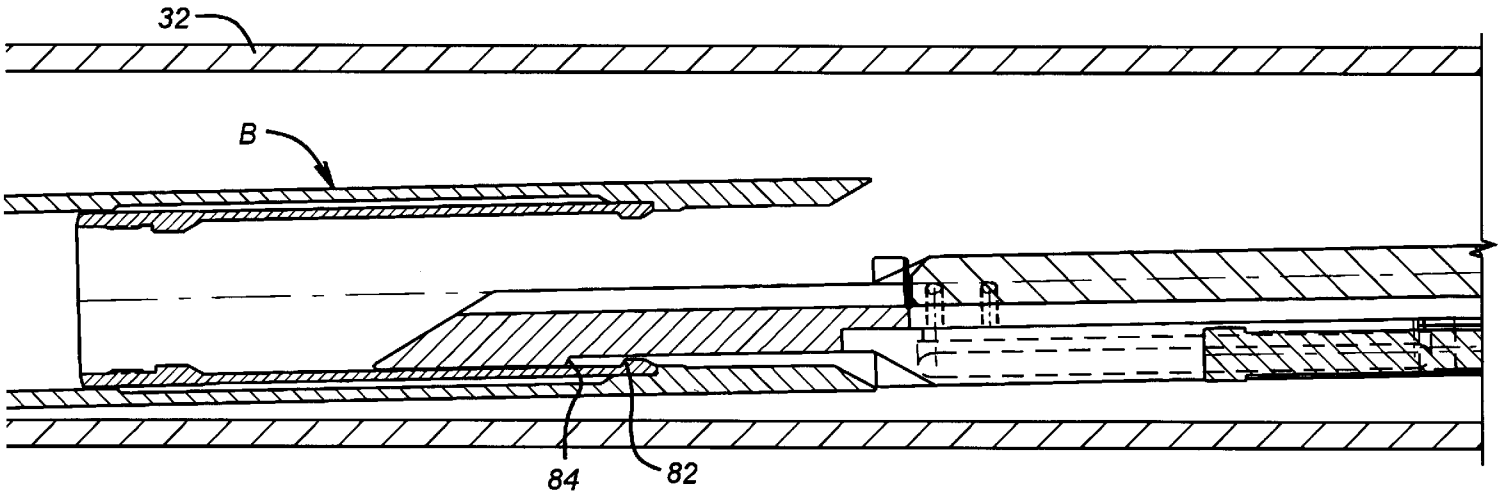
FIGS. 2*a–d* are the views shown in FIGS. 1*a–d,* with the whipstock in the set position.
Figure 2C:
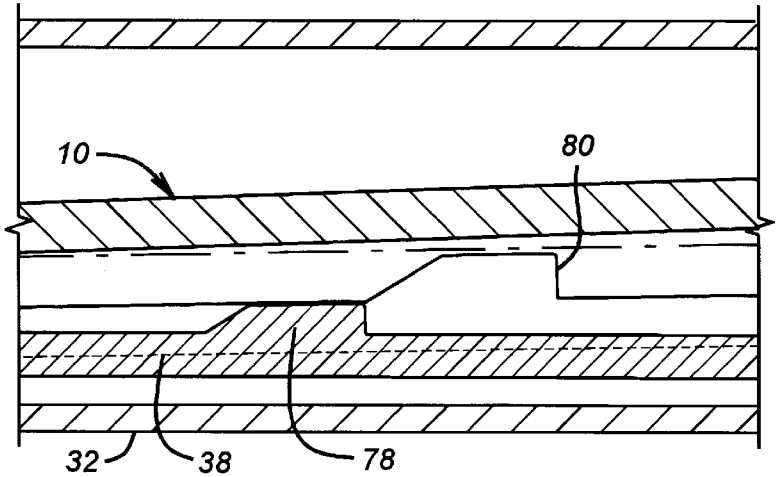
Figure 2D:
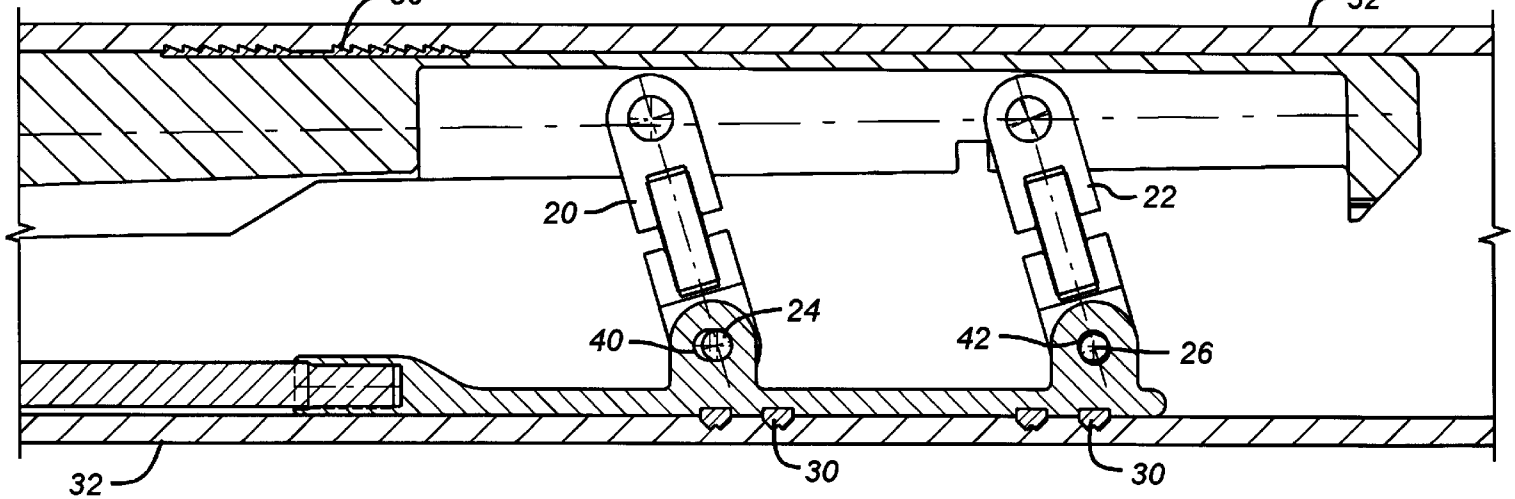

The setting of the whipstock 10 can be readily seen from comparing FIG. 1*d* to FIG. 2*d.* In that comparison, the relative movement between the rod 38 and the whipstock 10 has caused a pivoting of links 20 and 22 about pivots 16 and 18, respectively. The clockwise movement of links 20 and 22 has brought the inserts 30 into contact with the casing 32, while at the same time forcing teeth 36 up against the casing 32, 180° from the inserts 30. Thus, in the position of FIG. 2*d,* the whipstock 10 is set and anchored to the casing 32. The mechanism for obtaining the relative motion which brings up rod 38 can be seen in more detail by examining FIGS. 1*a–c* and FIGS. 4 and 5. It should be noted that the length of links 20 and 22 can be adjusted to accommodate the particular size of casing 32 being used so that the amount of travel of pad slip blank 28 coincides with engagement of the inserts 30 with the casing 32 before links 20 and 22 have rotated 90° from their run-in position. It should also be noted that the opening 40 is larger than pin 24, as shown in FIG. 2*d.* Additionally, opening 42 is somewhat larger than pin 26. The purpose of these two design features is to allow the pad slip blank 28 to seat itself as flush as possible against the casing 32 to ensure that the wedging action against the casing 32 by the inserts 30 is as nearly uniform as possible.

Referring now to the top end of the whipstock 10, as illustrated in FIGS. 1*a–c* and 4 and 5, rod 38 terminates at thread 41 in block 42. FIG. 1*b* illustrates a sectional elevational view of block 42 showing that it has a top end 44. The top end 44 is open and the slip block support 46 is inserted through that open end and held by a shear pin 48. In FIG. 1*b,* a thru-hole 50 is illustrated in block 42. There are actually three such holes, as better seen in FIG. 5. These holes provide an attachment point for the running tool R, as shown in FIG. 4. The running tool R holds the whipstock 10 stationary while creating relative movement by pulling up block 42. As seen in FIG. 1*b,* block 42 has a slot 52, through which fits an assembly of slip locks 54 and 56. Slip locks 54 and 56 are mounted opposed to each other and are biased against tapered or wedge-shaped bases or holders 58 and 60, respectively. Springs 62 and 64 respectively bias slip locks 54 and 56. Thus, when the running tool R is actuated and the block 42 is pulled upwardly with respect to the whipstock 10, which is held stationary by the running tool R, the block 42 is prevented from thereafter moving downwardly, which would tend to release the whipstock 10 because the springs 62 and 64 push the slip locks 54 and 56, respectively, outwardly into contact with the whipstock 10 so that the movement, as seen by comparing the position of the block 42 in FIGS. 1*b* and 2*b,* is retained by slip locks 54 and 56, which are disposed in the slot 52.

Figure 3A:
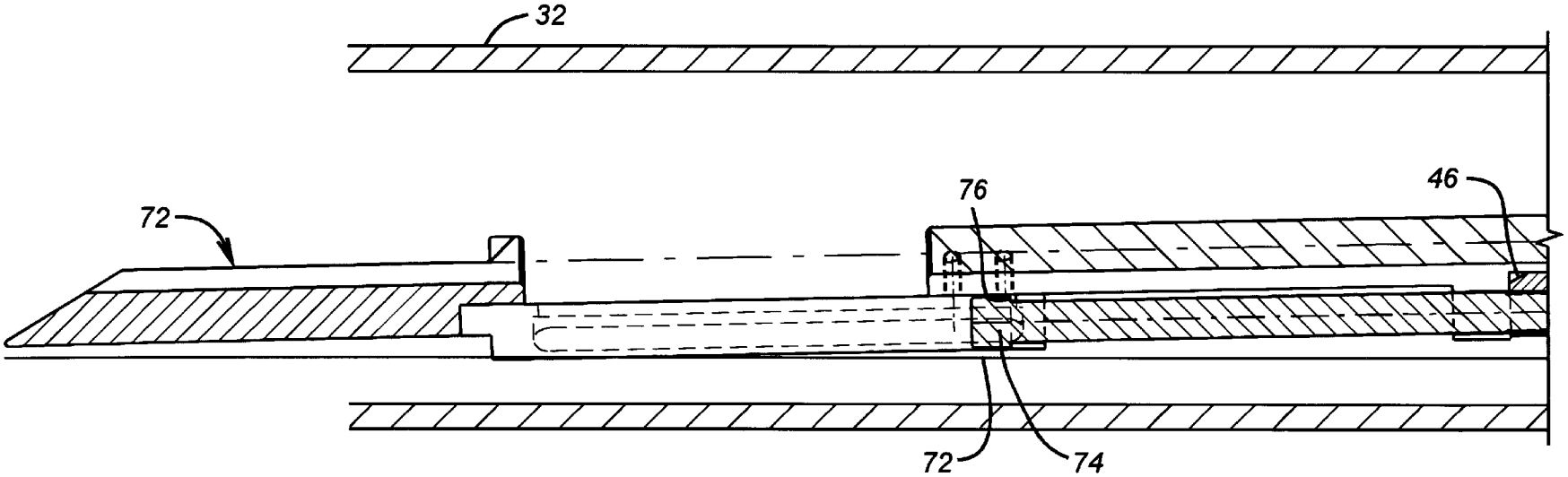
FIGS. 3*a–d* are the views of FIGS. 2*a–d,* with the whipstock in the released position.
Figure 5:
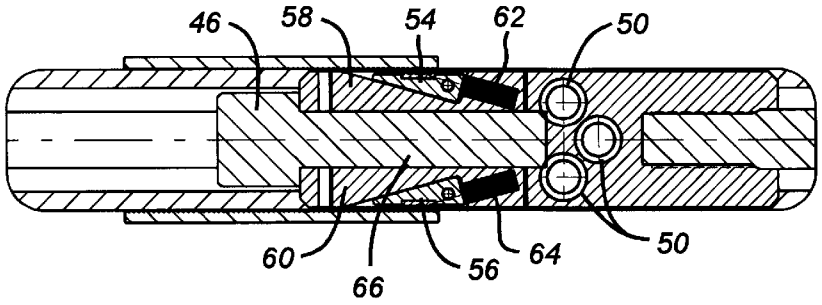
FIG. 5 is a section taken along lines 5—5 of FIG. 4.

The interaction between the slip lock support 46 and the holders 58 and 60 can be seen in FIG. 5. The holders 58 and 60 are held in place because the slip lock support 46 has an extending segment 66, which during run-in and set remains in position as long as shear pin 48 is not broken. In the position shown in FIG. 5, it supports the holders 58 and 60 so that the springs 62 and 64 can push the slip locks 54 and 56 outwardly along a taper on holders 58 and 60 against the casing 32. The slip lock support 46 is connected at thread 68 to release rod 70. Release rod 70 is in turn connected to the top shear cap 72. Release rod 70 has a head 74 which catches on a shoulder 76 of the top shear cap 72 for ultimate release of the whipstock 10, as shown in FIG. 3*a*.

The running tool R is directly connected to block 42 by shear pins (not shown) that extend through openings 50. When the running tool, which is of known design, is engaged, the block 42 is pulled upwardly while the whipstock 10 is prevented from upward movement. This relative movement picks up block 42 until the inserts 30 (see FIG. 2*d*) engage the casing 32, with the teeth 36 also engaging the casing 32. Further force delivered through the running tool R shears its connection to the block 42 to allow removal of the running tool with the whipstock 10 set. As previously described, the slip locks 54 and 56 prevent the block 42 from moving downhole with respect to the whipstock 10. These locks wedge against the whipstock 10 by virtue of the action of springs 62 and 64, as previously described, so that the set of the whipstock 10, which has been achieved as the running tool R is automatically released upon shearing free of block 42 has occurred. The fully set position is shown in FIGS. 2*a–d*.

Connected to rod 38 are a series of blocks 78 whose general position can be seen in FIG. 4. One of the blocks is shown in greater detail in FIG. 1*c*. During run-in, each of the blocks 78, which are affixed to the rod 38, rest in an opening 80 in whipstock 10 having a similar shape. As seen in comparing FIGS. 1*c* and 2*c,* the block 78 has moved out of its respective opening 80 so that it bears against the back side of whipstock 10. By looking at FIG. 4, it can be seen that there are several such blocks 78 disposed in the middle portion of the whipstock 10 so that when the rod 38 is shifted upwardly and the blocks 78 come out of their respective openings 80, greater support for the middle section of the whipstock 10 is provided as the rod 38, with blocks 78 now out of openings 80, provides underside support as the rod 38 itself is pulled closer towards the casing 32 when actuated by the running tool R. FIGS. 1*c* and 2*c* can be compared to see that upon actuation, the rod 38 has moved closer to the casing 32. At this point the whipstock 10 is in position for the milling of a window and the drilling of a lateral by known techniques.

Figure 3B:
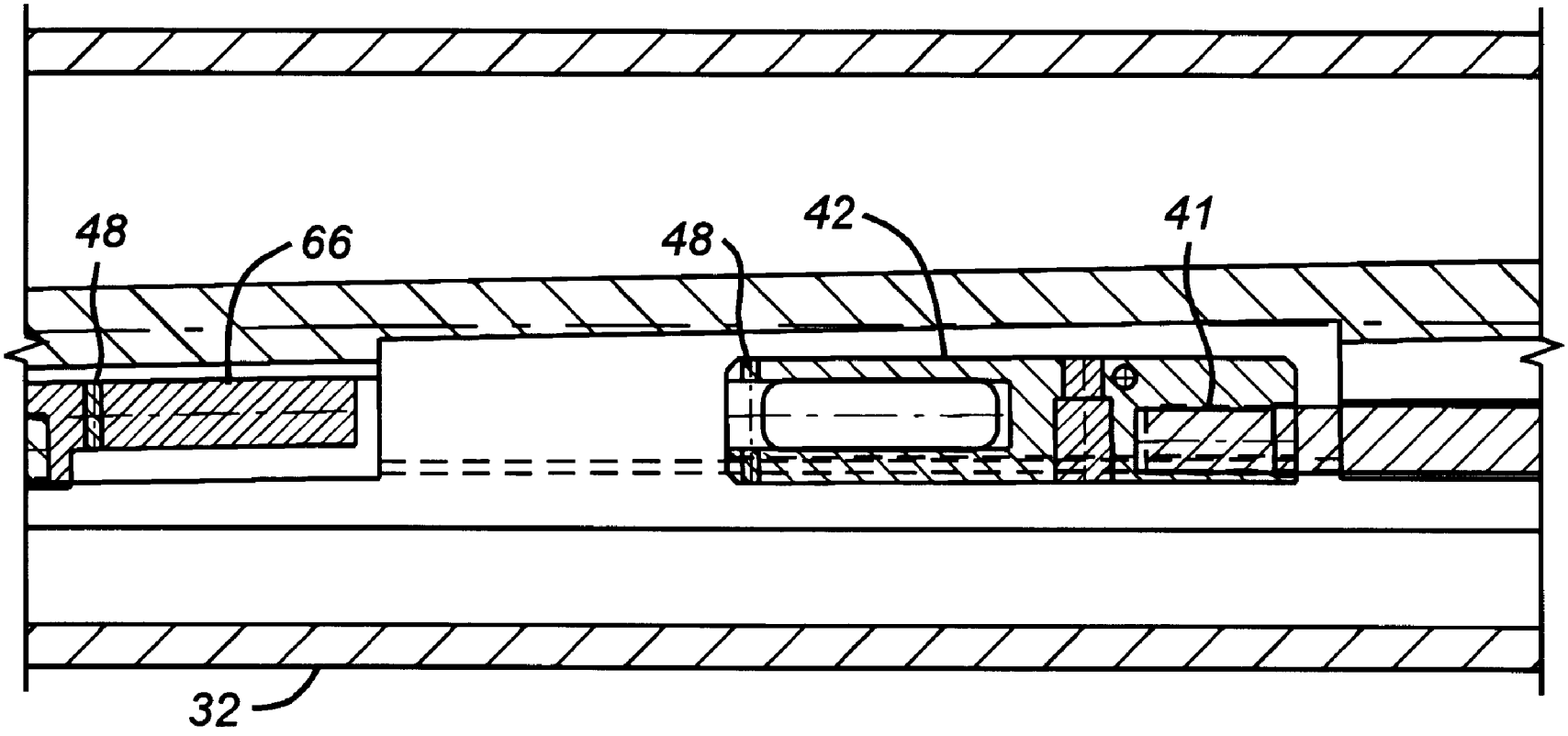
Figure 3C:
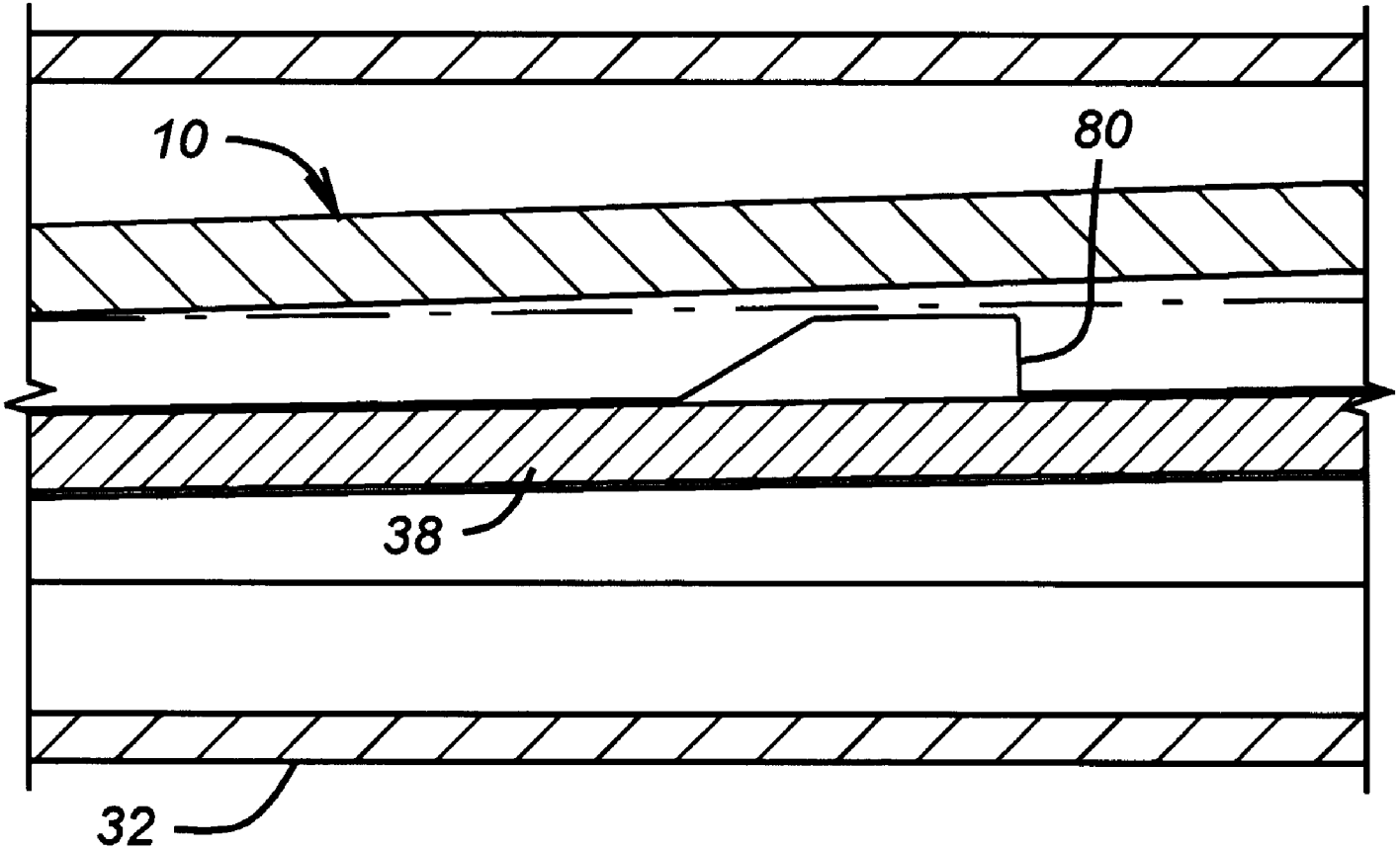
Figure 3D:
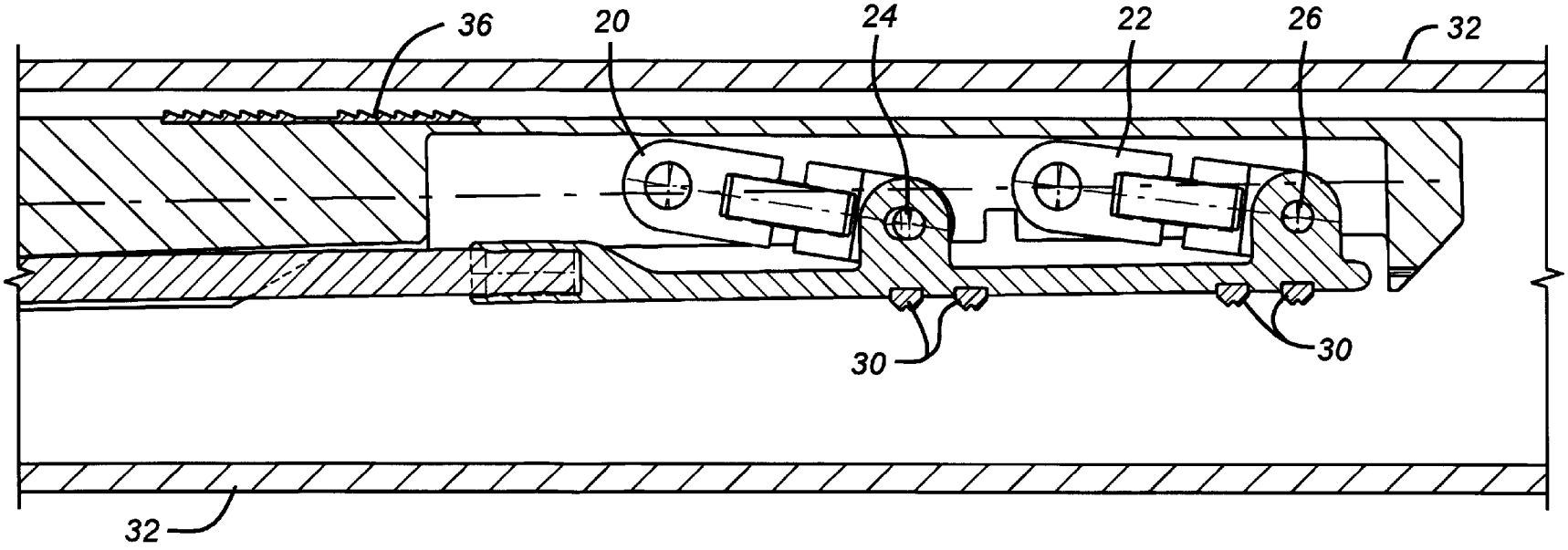

FIG. 2*a* illustrates the use of a retrieval tool B. Retrieval tool B has a series of collets 82 which can engage shoulder 84 on top shear cap 72. With the retrieval tool B in position as shown in FIG. 2*a,* an upward force brings up top shear cap 72, as can be seen by comparing FIG. 2*a* to FIG. 3*a,* where the retrieval tool B has been omitted in FIG. 3*a* for clarity. The shoulder 76 eventually catches head 74, pulling it up and along with it, slip lock support 46. The shear pin 48, as shown in FIG. 3*b,* has broken. The extending segment 66 has been pulled out from between the holders 58 and 60, and in FIG. 3*b,* is shown completely clear of block 42. With extending segment 66 out of block 42, the holders 58 and 60 collapse inwardly, thus releasing the bite of slip locks 54 and 56. The retrieval tool B is then still connected to the whipstock 10, and by an upward force on the whipstock 10 with slip locks 54 and 56 no longer engaging the whipstock body 10, the whipstock 10 moves upwardly, which rotates links 20 and 22 counterclockwise about pivots 24 and 26 as the whipstock 10 is retrieved through the tubing. It should be noted that the breaking of the shear pin 48 and the removal of the extending member 66 releases any tensile loads on rod 38. That movement alone can result in the rotational motion of links 20 and 22, as shown in FIGS. 2*d* and 3*d* to effectuate the release. However, the release can also be facilitated by pulling up on the retrieval tool B, which brings up the whipstock 10 relative to the pad slip blank 28 to effectuate a release.

Those skilled in the art will appreciate that the design presented is simple, easy to build and, therefore, is generally reliable to facilitate simple setting and release of the whipstock 10. A No. E-4 #10 tool produced by Baker Oil Tools can be used as the running tool R. Thus, an improvement over the design illustrated in U.S. Pat. No. 5,494,111, whose contents are incorporated by reference herein as if fully set forth, is readily disclosed. As opposed to the design illustrated in the '111 patent, the current invention discloses a retrievable whipstock that is insertable through tubing.

The foregoing disclosure and description of the invention are illustrative and explanatory thereof, and various changes in the size, shape and materials, as well as in the details of the illustrated construction, may be made without departing from the spirit of the invention.

I claim:

1. A retrievable, thru-tubing whipstock, set in a cased or uncased borehole, comprising:

a whipstock;

a collapsible anchor assembly actuable by an actuator mounted to the whipstock;

a lock mechanism on the actuator mechanism to selectively hold the anchor assembly when the whipstock is in use and to selectively release the anchor assembly when the whipstock is to be retrieved.

2. The whipstock of claim 1, wherein:

the lock mechanism comprises of at least one slip which is biased into a securing position downhole to selectively hold the anchor assembly in a position to support the whipstock.

3. The whipstock of claim 2, wherein:

the slip is biased adjacent a support for movement into contact with the whipstock, which support is selectively removable to release the grip of the slip.

4. The whipstock of claim 1, wherein:

the whipstock comprises a camming surface;

the actuator comprises a protrusion so that upon movement of the actuator, portions of the whipstock are cammed in the borehole.

5. The whipstock of claim 4, wherein:

the actuator is connected to the whipstock by at least one link;

the whipstock has a longitudinal axis such that movement of one end of the actuator in a direction along the longitudinal axis will cause the portion linked to the whipstock to move away from the whipstock until it contacts the borehole.

6. The whipstock of claim 5, wherein:

the actuator has teeth to grip the borehole when contact is made.

7. The whipstock of claim 6, wherein:

the whipstock has teeth to grip the borehole in an opposed orientation to the teeth on the actuator.

8. The whipstock of claim 7, wherein:

the link turns less than 90° before the teeth on the actuator contact the borehole.

9. The whipstock of claim 3, wherein:

the support is retained in position by a breakable member which, when broken, allows support for the slip to be removed.

10. The whipstock of claim 9, further comprising:

a retrieving tool, insertable through the tubing in the wellbore to operably engage the breakable member to selectively break it so that the whipstock can be retrieved through the tubing.

11. The whipstock of claim 4, wherein:

actuation of the anchor assembly forces a portion of the whipstock laterally in a first direction in the borehole;

the protrusion on the actuator also cams another portion of the whipstock in the first direction.

12. The whipstock of claim 10, wherein:

the whipstock has a shoulder on a movable sleeve and the retrieving tool has a grip which engages the shoulder, whereupon movement of the sleeve breaks the breakable member.

13. The whipstock of claim 9, wherein:

the whipstock comprises a camming surface;

the actuator comprises a protrusion so that upon movement of the actuator, portions of the whipstock are cammed in the borehold.

14. The whipstock of claim 13, wherein:

the actuator is connected to the whipstock by at least one link;

the whipstock has a longitudinal axis such that movement of one end of the actuator in a direction along the longitudinal axis will cause the portion linked to the whipstock to move away from the whipstock until it contacts the borehole.

15. The whipstock of claim 14, wherein:

the actuator has teeth to grip the borehole when contact is made.

16. The whipstock of claim 15, wherein:

the whipstock has teeth to grip the borehole in an opposed orientation to the teeth on the actuator.

17. The whipstock of claim 16, wherein:

the link turns less than 90° before the teeth on the actuator contact the borehole.

18. The whipstock of claim 17, further comprising:

a retrieving tool, insertable through the tubing in the wellbore to operably engage the breakable member to selectively break it so that the whipstock can be retrieved through the tubing.

19. The whipstock of claim 18, wherein:

actuation of the anchor assembly forces a portion of the whipstock laterally in a first direction toward the borehole;

the protrusion on the actuator also cams another portion of the whipstock in the first direction.

20. The whipstock of claim 19, wherein:

the whipstock has a shoulder on a movable sleeve and the retrieving tool has a grip which engages the shoulder, whereupon movement of the sleeve breaks the breakable member.

* * * * *